United States Patent [19]

Howard et al.

[11] Patent Number: 4,545,305

[45] Date of Patent: Oct. 8, 1985

[54] COMBINED PRIMARY AND SPARE SUBMERGED SCRAPER CONVEYOR ARRANGEMENT

[75] Inventors: Guy D. Howard, Vernon; Alexander Bosso, Broad Brook, both of Conn.

[73] Assignee: Combustion Engineering, Inc., Windsor, Conn.

[21] Appl. No.: 657,912

[22] Filed: Oct. 5, 1984

[51] Int. Cl.[4] ..... F23J 1/00

[52] U.S. Cl. ..... 110/165 R; 110/171

[58] Field of Search ..... 110/170, 171, 165 R; 414/214

[56] References Cited

U.S. PATENT DOCUMENTS

| | | | |
|---|---|---|---|
| 2,685,853 | 8/1954 | Schlick | 110/165 R |
| 3,915,105 | 10/1975 | Michelbrink | 110/171 |
| 3,931,773 | 1/1976 | Reimann | 110/171 |
| 4,112,856 | 9/1978 | Fuhrman et al. | 110/171 |
| 4,227,469 | 10/1980 | Collura | 110/171 |
| 4,300,457 | 11/1981 | Moore | 110/171 |
| 4,301,746 | 11/1981 | Pech et al. | 110/171 |
| 4,387,651 | 6/1983 | Moore | 110/171 |

*Primary Examiner*—Henry C. Yuen

*Attorney, Agent, or Firm*—Robert L. Olson

[57] ABSTRACT

An ash disposal system for a furnace (10) including a pair of submerged scraper conveyors (24, 26) mounted within a common water-filled tank (16) with a water seal (18, 28) between the tank and furnace. The tank is mounted on wheels (32) and has a divider wall (30) between the two conveyors so that the tank can be positioned such that one or the other, or both conveyors together, can be operated to remove ash from the tank. A door or gate (34) in one of the side walls of the tank permits the tank to be completely removed from beneath the furnace when desired.

2 Claims, 2 Drawing Figures

COMBINED PRIMARY AND SPARE SUBMERGED SCRAPER CONVEYOR ARRANGEMENT

BACKGROUND OF THE INVENTION

In coal-fired steam generators, it is necessary to provide the means for handling and disposing of the large amount of ash created in the furnace. One present day means is by continuously removing ash and slag by gravity through an opening in the furnace bottom. The ash falls into a water-filled tank, and is continuously removed therefrom by means of a submerged scraper conveyor.

A water seal is generally provided to isolate the atmosphere from the furnace interior. This consists of a plate extending down and surrounding the furnace bottom opening, which plate extends into the water-filled tank thus forming a water seal. This type of seal is provided because it allows the furnace to grow relative to the submerged scraper conveyor unit caused by thermal expansion. Large furnaces are generally top-supported so that they are free to expand in a downward direction when the unit is first started up. This growth can be on the order of 10–12 inches from the cold to the hot condition. The above provides the problem of how to be able to economically continue to operate the steam generator when the submerged scraper conveyor unit breaks down and is in need of repair.

One arrangement for overcoming the above is by providing a tank having two side-by-side conveyors in it. When one breaks down, the tank can be moved a short distance and the other conveyor is put into operation. Such apparatus is shown in U.S. Pat. No. 4,301,746. The present invention is a simple, more reasonably priced unit, which has improvements over the apparatus shown in the above patent.

SUMMARY OF THE INVENTION

In accordance with the invention, a water-filled tank is positioned beneath a furnace bottom, which tank contains two side-by-side submerged scraper conveyors therein. The unit is capable of operating with just one or the other of the conveyors, or if there is an increase of generated ash both conveyors can be used simultaneously. A hinged door on one side of the tank permits the entire unit to be rolled away from beneath the furnace, so that repair work can be conveniently done during normally scheduled shutdowns of the steam generator.

DESCRIPTION OF THE PREFERRED EMBODIMENT

Figure 1:
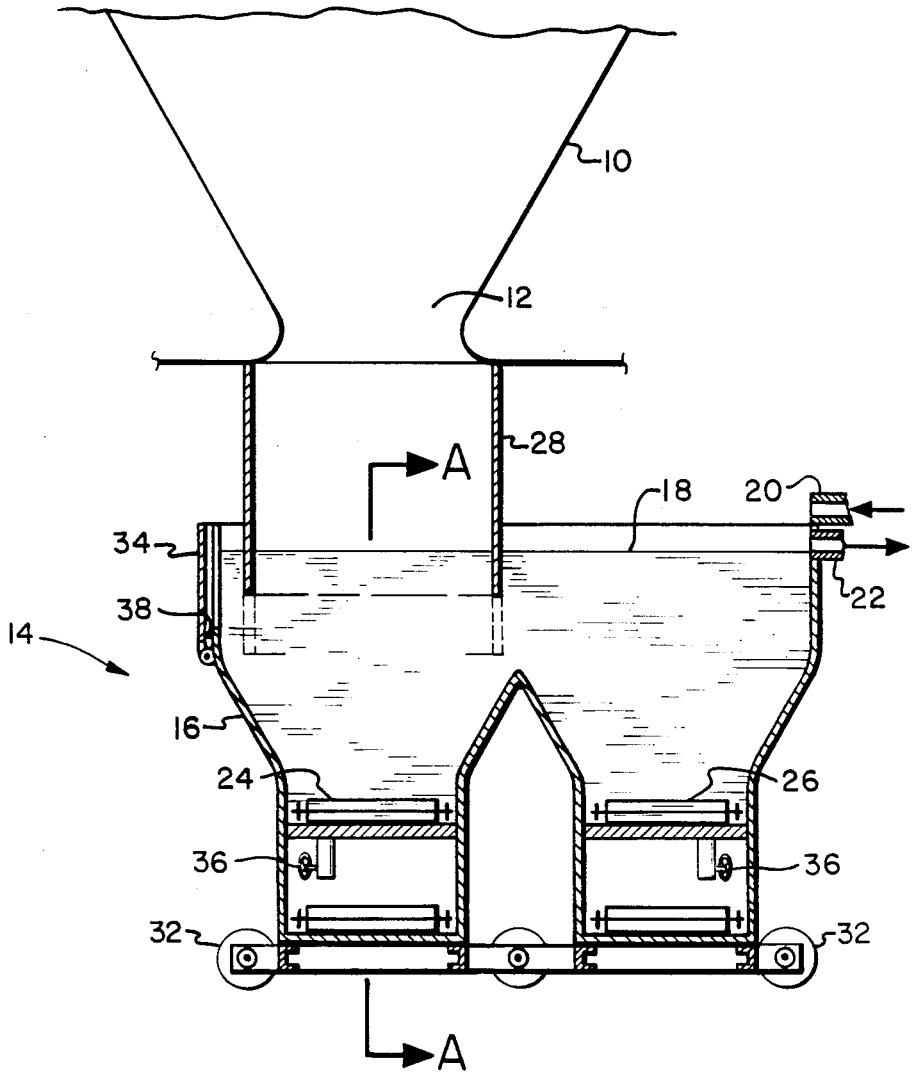
FIG. 1 is a sectional side view of a submerged scraper conveyor unit constructed in accordance with the invention.
Figure 2:
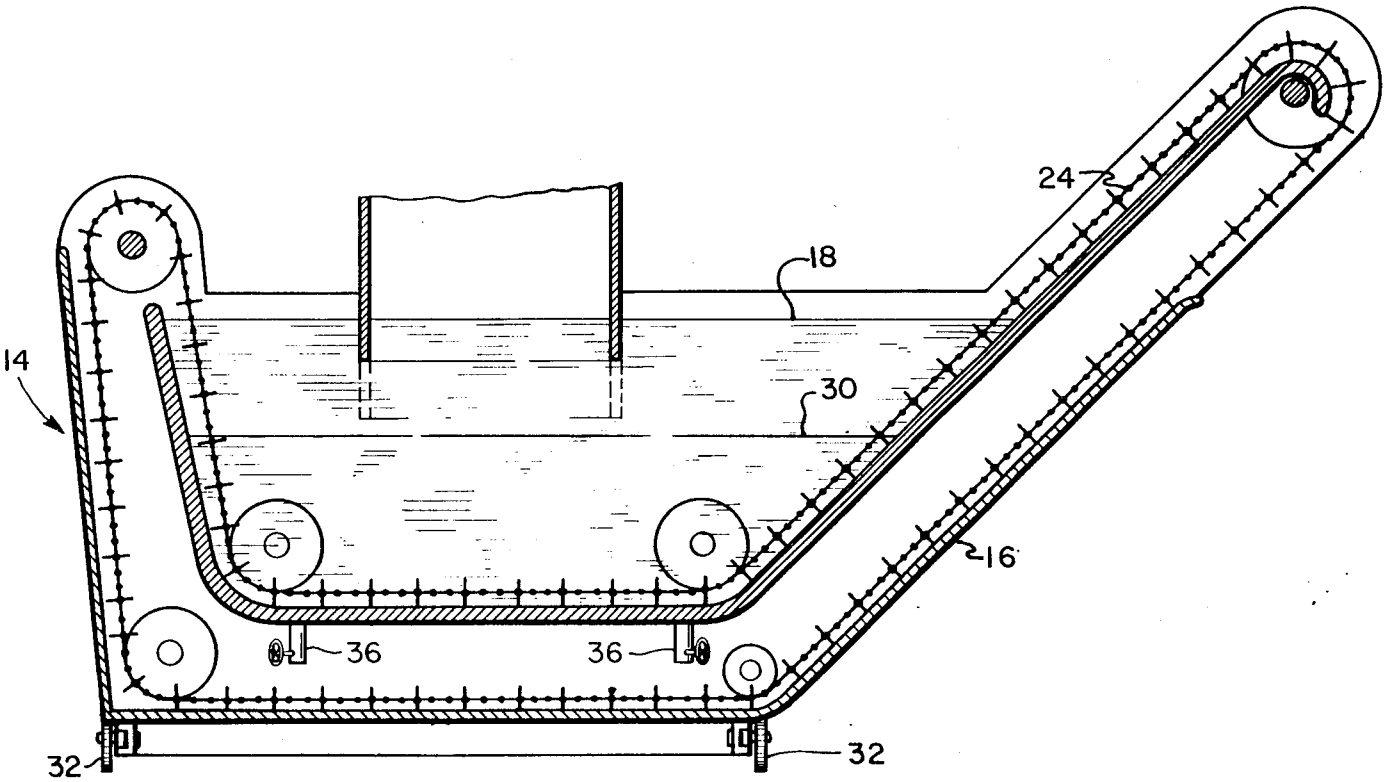
FIG. 2 is a view, reduced in scale, and taken on line A—A of FIG. 1.

Looking now to the drawings, numeral 10 designates a furnace bottom of a steam generator in which coal is burned. The furnace is top-supported in any well-known manner. Molten ash and slag is discharged through the furnace bottom opening 12, and falls into the submerged scraper conveyor unit 14. The tank 16 of the unit is filled with water to a level 18. In order to keep the water in the tank at a relatively cool temperature (160° F. or less) inspite of the heat input from the slag and ash constantly entering it, ambient water is continuously supplied through pipe 20. An overflow pipe 22 maintains the water at the desired level 18. The tank 16 contains a pair of submerged scraper conveyors 24 and 26 with integral scraper blades in the bottom thereof, by means of which the cool ash and slag is continuously removed from the tank (FIG. 2). During normal operation, the upper run of the conveyor 24 carries the clinkers to the end of the tank, where they can be discharged into trucks or onto a mechanical conveyor (not shown) and transported away.

A water seal permits thermal expansion of the top-supported furnace 10 while preventing exposure of the interior thereof to the atmosphere. The water seal is formed by plate 28 which is secured to the bottom of the furnace and extends downwardly into the water in tank 16. The plate 28 extends around the entire periphery of the opening 12, so as to completely seal the opening between the furnace 10 and the submerged scraper conveyor unit 14. During normal operation of the furnace, the plate 28 extends downwardly into the water in tank 16 so as to form the seal. A center divider wall 30 coacts with the plate 28 so as to direct the falling ash into the water above the primary conveyor 24 during normal operation. If this conveyor breaks down, the tank 16 can be rolled to the left so that conveyor 26 can handle the ash. The tank 16 is mounted on wheels 32 so that it can be readily moved when desired. In the above manner, the unit can be kept in operation while maintaining the water seal by placing the spare conveyor 26 beneath the furnace bottom opening 12. Thus the steam generator need not be shutdown because of a failure of the primary conveyor 24.

The conveyor unit 14 can also be completely removed from the beneath the furnace. Thus during a regularly scheduled shut down of the steam generator, the unit 14 can be wheeled to the side where workers can easily performed any needed maintenance to one or the other or both of the conveyors 24 and 26. This is made possible by providing a hinged door or gate 34 on one of the sides of the tank 16. Thus when it is desired to move the unit from beneath the furnace, the water level is first lowered by removing water through one of the drains 36 and then door 34 is opened. This permits the tank 16 to be rolled to the right without any interference with plate 28. A neoprene gasket 38 prevents leakage through the crack between the door and its frame when it is in its normal operating position.

In some steam generators during the life of the unit, which can be several decades, the make up of the available coal being fired, can change drastically. Thus, the ash content of the coal that may be available several years in the future, could be considerably higher than that for which the unit was originally designed for. If this occurs, the unit can be operated with both conveyors 24 and 26 being used simultaneously. The tank 16 would then be positioned with divider wall 30 directly beneath the center of the furnace bottom opening 12, so that the falling ash and slag is more or less evenly divided between the two conveyors. Also, on occasion steam generators are operated at loads somewhat above full-load capacity for brief periods of time. The above would be useful for this operation also. The tank 16 can be easily and quickly moved to this position without the loss of the water seal, and without any assembly and disassembly of structure required.

We claim:

1. In combination a top-supported furnace in which coal or other ash-bearing fuel is burned, opening means in the furnace bottom, a bottom supported tank formed of outer walls open at its upper end and containing water positioned beneath the furnace opening means, into which the ash from the furnace falls, a pair of side-by-side scraper conveyors positioned within the tank for removing the ash from the tank, the tank being mounted on movable means so as to permit one or the other of the conveyors to be positioned directly under the furnace bottom opening means, plate means secured to the furnace bottom extending down into the water in the tank, which plate means completely surround the furnace bottom opening means, a divider wall in the tank between the two conveyors, said divider wall extending to a height above the conveyors but below the bottom edge of the plate means, so that the tank can be moved so as to position either one of the conveyors directly beneath the furnace bottom opening means without removing the plate means from the water in the tank, and a hinged door on one of the outer walls of the tank, said door being of such size and configuration that when the door is open it permits the tank to be moved to the side without interference with the plate means, and gasket means surrounding the door for preventing water leakage from the tank when the door is closed.

2. The combination set forth in claim 1, including means for controlling the water level within the tank at a given level, which means is positioned in one of the outer walls of the tank.

* * * * *